United States Patent [19]

Laiacona

[11] 4,232,190

[45] Nov. 4, 1980

[54] APPARATUS FOR COMBINING PHONOGRAPH SIGNAL WITH AUXILIARY AUDIO SIGNAL

[76] Inventor: Michael N. Laiacona, 213 Shipbuilders Creek, Webster, N.Y. 14580

[21] Appl. No.: 875,238

[22] Filed: Feb. 6, 1978

[51] Int. Cl.[3] ..... H04R 5/00

[52] U.S. Cl. ..... 179/1 B; 179/1 G

[58] Field of Search ..... 179/1 MN, 1 B, 1 G, 179/1 GQ, 100.1 TD

[56] References Cited

U.S. PATENT DOCUMENTS

| | | | |
|---|---|---|---|
| 3,830,978 | 8/1974 | Odagi | 179/1 GQ |
| 3,941,931 | 3/1976 | Osakabe | 179/1 G |

OTHER PUBLICATIONS

N. Crowhurst, "High Fidelity Sound Engineering", Newnes Ltd., 1961, pp. 222–229.

H. Tremaine, *Audio Cyclopedia,* H. Sams Co., 1969, pp. 419, 425.

*Primary Examiner*—Malcolm A. Morrison
*Assistant Examiner*—E. S. Kemeny
*Attorney, Agent, or Firm*—Shlesinger, Fitzsimmons & Shlesinger

[57] ABSTRACT

The output signals of a phonograph and of an auxiliary audio signal source, such as a high impedance microphone, electric guitar, or the like, are combined before being fed to the amplifier of the phonograph, whereby the combined signals are amplified without distortion, and are fed to one or more speakers, thus audibly reproducing the phonograph recording with the auxiliary sound signal superimposed thereover. The device which combines the signals includes means for suppressing the base frequencies in the auxiliary signal, and for selectively adjusting the amplitudes of the two signal components.

5 Claims, 1 Drawing Figure

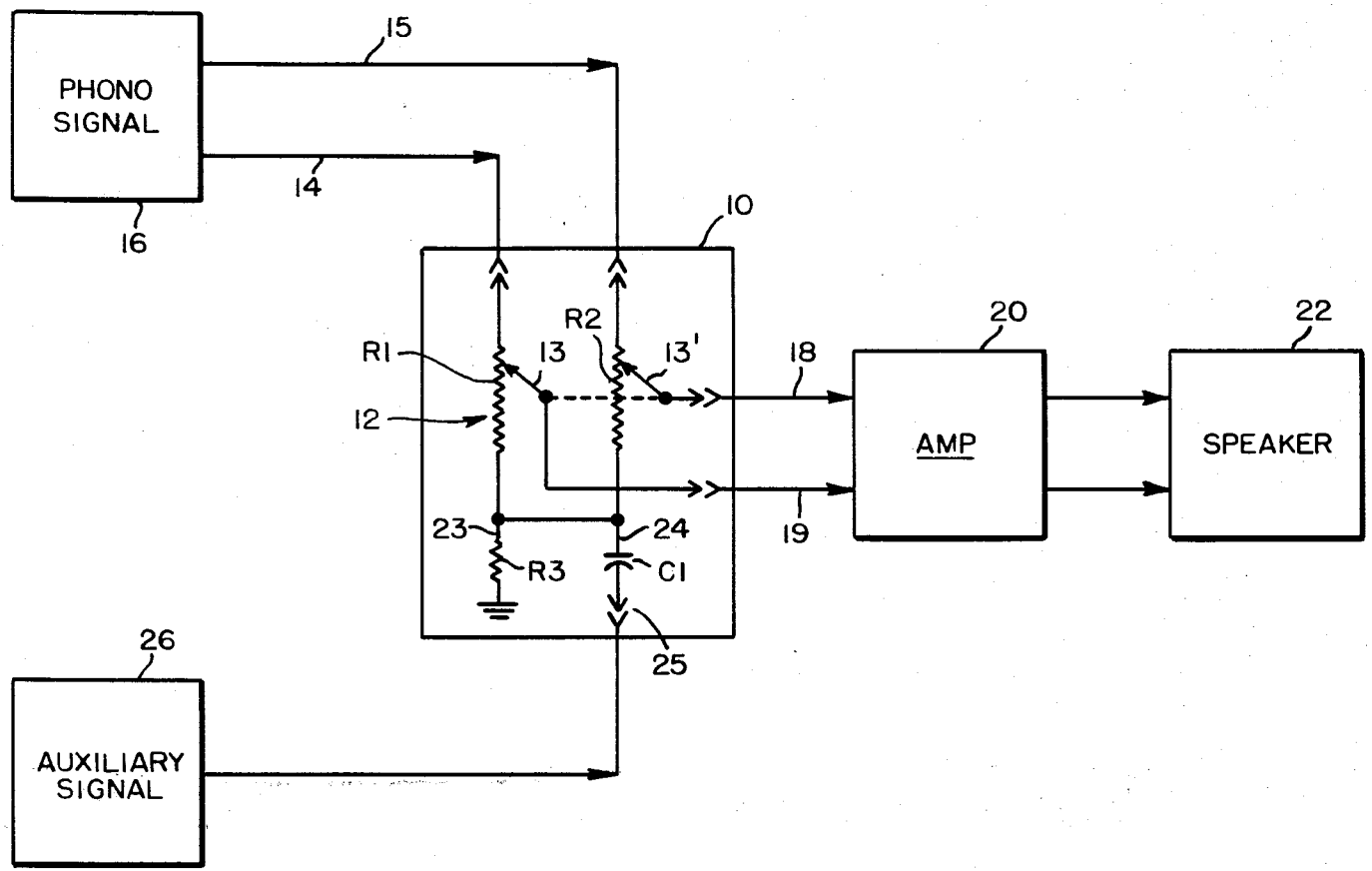
SPEAKER
22
AMP
20
18
19
10
13'
R2
13
R1
12
24
C1
25
R3
23
15
14
PHONO SIGNAL
16
26
AUXILIARY SIGNAL

APPARATUS FOR COMBINING PHONOGRAPH SIGNAL WITH AUXILIARY AUDIO SIGNAL

This invention relates to apparatus for combining audio signals, and more particularly to apparatus for combining an auxiliary audio signal with the output signal of a phonograph, or the like. Even more particularly, this invention relates to a novel device for selectively amplifying the combining the signals from a microphone, electric guitar, or the like, with the signals produced by the needle of a conventional phonograph.

As is known by those skilled in the art, the electrical signal that is generated by a conventional phonograph needle or tape player head is fed to an associated amplifier, which amplifies the signal and feeds it to one or more speakers, which in turn produce an audible sound. While it is desirable to be able to superimpose a second audio signal on the signal which is emanating from the phonograph needle, this heretofore has not been possible, except by multiple taping or recording processes.

For example, it is common for artists to make several recordings of the same song or musical piece, superimposing the second and successive recordings on the immediately preceding recording. In this way it is possible for the same vocalist, for example, to record a song in three-part harmony, each part having been recorded by the same artist.

Efforts have been made to superimpose a second audio signal on the one emanating from a phonograph, tape player, or the like, but heretofore the results have been very unsatisfactory because of the interference which is normally introduced when the two signals are fed to an associated amplifier. One reason for this difficulty, at least in the case of conventional electrical phonographs, is that the associated amplifier contains a circuit which functions differently depending upon the frequency of the input signal.

It is an object of this invention, therefore, to provide improved audio apparatus capable of combining a recording signal with an auxiliary audio signal without introducing distortion of the type heretofore encountered.

Another object of this invention is to provide a novel device which will permit the superimposing of a second audio signal onto the audio signal produced by the needle of a conventional phonograph, or the like.

Another object of this invention is to provide a novel device of the type described which will enable an artist, such as a vocalist or instrumentalist, to superimpose his or her voice signal or instrument signal directly onto the output of a phonograph, so that both signals will be heard simultaneously from the associated speaker or speakers.

A more specific object of this invention is to provide a novel electronic device which will enable the output of a phonograph to be combined with an auxiliary audio signal at the input to the amplifier for the associated phonograph, whereby the output of the amplifier will cause the associated speaker system to produce a sound which will be a combination of the two input signals.

Other objects of the invention will be apparent hereinafter from the specification and from the recital of the appended claims, particularly when read in conjunction with the accompanying drawing.

In the drawing the sole FIGURE is a wiring diagram illustrating schematically audio signal apparatus and a signal superimposing device therefor made according to one embodiment of this invention.

Referring now to the drawing by numerals of reference, 10 denotes a metal or plastic housing containing a potentiometer, which is denoted generally at 12. The potentiometer comprises a pair of resistors R1 and R2, 13' and a pair of sliding contacts 13, which are ganged or otherwise coupled together to slide in unison on the resistors R1 and R2 in response to the operation of a conventional knob or the like (not illusrated), which is mounted on the exterior of housing 10. This potentiometer 12 may be of the 100K, linear taper, dual gange type.

At one end thereof the resistors R1 and R2 are adapted to be connected releasably by conventional jacks (not illustrated) and lines 14 and 15 with the output of a conventional phonograph denoted at 16. The slidable potentiometer contacts 13, 13' are adapted to be connected also by conventional jacks (not illustrated) and lines 18 and 19 with the input of a conventional phonograph amplifier 20. In other words, the output or phonograph signal from the phonograph 16 could be fed directly to the input (18, 19) of the amplifier 20, if desired. In the present case, however, the phonograph signal passes through the potentiometer 12 before reaching the amplifier 20. The output of amplifier 20 is fed in a conventional manner to a speaker and/or speakers 22 associated with the phonograph 16.

At their ends remote from the lines 14 and 15 the resistors R1 and R2 are connected by a line 23 through a resistor R3 to ground, and through a line 24 and a capacitor C1 to an input terminal 25, which is adapted releasably to be connected to the signal output of an auxiliary signal device 26. This auxiliary signal device may comprise a conventional microphone, an electric guitar, or a similar device capable of generating an audio signal of the type which is capable of being amplified and fed to the speaker system 22.

In use, the phonograph signals are fed simultaneously on lines 14 and 15 to one side of the potentiometer 12; and the auxiliary signal from device 26 is fed by the input terminal 25 to one side of the capacitor C1. This capacitor, which may have a rating of, for example, 0.0047 farads, functions to cut the base response of the voice or instrument input signal on line 25 before the signal is combined with the phonograph signal at the potentiometer 12. In combination with resistor R3 it suppresses or rolls off the amplitude of the base signal appearing on line 25. This is a high impedance signal, such as is usually produced by a microphone, an electric guitar, etc., and its low frequency is attenuated by applicant's novel circuit prior to amplification by an amplifier 20.

One of the problems solved by this novel device relates to the elimination of signal distortion. The amplifier 20, which is the usual amplifier associated with a conventional phonograph, includes a circuit which is designed to cut the high frequencies of the signals entering on lines 18 and 19, and to boost the low frequency signals. Since the signal entering on line 25 is usually a high impedance signal, if it is combined with the phonograph signal 16 without employing applicant's novel unit, the boosting circuit in the amplifier 20 will cause the low frequency portion of the auxiliary signal from 26 to be boosted to a point where it distorts the composite signal which is fed to the speaker system 22. Applicant's novel circuit, however, reduces or rolls off the amplitude of the base signal entering on line 25 before it is combined with the phonograph signal 16, so that when the combined signal is fed at 18, 19 into the amplifier 20, subsequent cutting and lifting of the high and low frequencies, respectively, in the amplifier, will not produce any distortion of the signal fed to the speaker system 22.

The potentiometer 12 enables the operator selectively to increase or decrease the amplitude of either the phonograph signal component, or the auxiliary signal component, at the point where they are combined. Consequently, when the combined or composite signal appears at the speaker system 22, either the phonograph signal or the auxiliary signal can be emphasized, or the two signals can be made substantially equal, as desired.

From the foregoing it will be apparent that the instant invention provides a relatively simple and inexpensive means for superimposing an auxiliary audio signal upon the output of a phonograph, tape player, or the like, and for feeding this composite signal to the input of an associated amplifier, which then produces an amplified signal free of distortion. The auxiliary signal can be the output of, for example, a microphone, an electric guitar, etc., so that one can either sing along with or play along with the music that is being produced by the phonograph, but with the music from the phonograph and from the microphone or guitar being superimposed and appearing simultaneously at the speaker system 22 without any distortion of either signal. Moreover, the potentiometer 12 provides a simple, manual means for the operator selectively to increase or decrease the amplitude of either signal component, so that either the phonograph or the auxiliary signal can be emphasized at the speaker system 22, if desired.

While this invention has been illustrated and described in connection with only a single embodiment thereof, it will be apparent that it is capable of still further modification, and that this application is intended to cover any such modifications as may fall within the scope of one skilled in the art or the appended claims.

Having thus described my invention, what I claim is:

1. Audio signal apparatus for combining an auxiliary audio signal with each of a plurality of audio signals emanating from a primary audio signal source such as a phonograph or the like, comprising a primary signal source for producing a plurality of first audio signals, an auxiliary device for producing independently of said primary source a second audio signal from a source having a relatively high impedance compared to that of said primary signal source, means for combining said second signal with each of said first signals to produce a plurality of composite audio signals each comprising components of said first and second signals, and an amplifier for amplifying said composite signals and for applying the amplified signals to one or more speakers, said combining means including means for attenuating the low frequency portion of said second signal prior to combining said first signals with said second signal, thereby to prevent distortion of the amplified composite signals, and said combining means further including means for selectively adjusting the amplitude of said first and second signals, respectively, whereby one of the signal components of each of said composite signals may be amplified greater than the other.

2. Audio signal apparatus as defined in claim 2, wherein said amplifier is a dual amplifier, said means for adjusting the amplitude of said signals comprises a dual potentiometer interposed between the sources of said first and second signals, and said dual potentiometer has a first pair of inputs connected to the signal outputs of said primary source and a second pair of inputs connected commonly to said auxiliary device, and has a pair of adjustable output contacts connected to the inputs of said dual amplifier to feed said composite signals thereto.

3. Audio signal apparatus as defined in claim 2, wherein said attenuating means comprises a capacitor interposed between said dual potentiometer and said second signal, and a resistor connected at one end to ground and at its opposite end to a point located between and common to said dual potentiometer and said capacitor.

4. A device for superimposing at least one audio signal from a first source onto each of a plurality of audio signals produced by a phonograph, which is independent of said first source, prior to amplification of the composite audio signals by a phonograph amplifier, comprising a housing having therein a plurality of signal inputs, a pair of resistors in said housing, means for connecting an audio signal from said first source through at least one of said signal inputs commonly to one end of each of said resistors, means for connecting a pair of audio signals from said phonograph through two others of said inputs and respectively to the opposite ends of said resistors, adjustable means for adjustably connecting said two resistors intermediate the ends thereof to two separate inputs of a dual amplifier, said first source having a relatively high impedance compared to that of said phonograph, and said means for connecting said first signal source to said resistors including means for suppressing the low frequency portion of said signal from said first source, thereby to prevent signal distortion which would otherwise occur upon amplification of the composite signal by said dual amplifier.

5. A device as defined in claim 4 wherein said suppressing means comprises a capacitor disposed to have one side thereof connected releasably to said first signal source, and connected commonly at its opposite side to said one ends of said resistors, and a further resistor is connected at one side to ground and at its opposite side to said opposite side of said compacitor and to said one ends of said pair of resistors.

* * * * *